US005404077A

United States Patent [19]

Eichelbrönner et al.

[11] Patent Number: 5,404,077

[45] Date of Patent: Apr. 4, 1995

[54] HIGH-PRESSURE DISCHARGE LAMP

[75] Inventors: Gottfried Eichelbrönner, München; Stefan Jüngst, Zorneding, both of Germany

[73] Assignee: Patent-Treuhand-Gesellschaft Fuer Elektrische Gluehlampen mbH, Munich, Germany

[21] Appl. No.: 912,347

[22] Filed: Jul. 13, 1992

[30] Foreign Application Priority Data

Aug. 20, 1991 [DE] Germany ..... 41 27 555.1

[51] Int. Cl.[6] ..... H01J 17/18

[52] U.S. Cl. ..... 313/623; 313/625

[58] Field of Search ..... 313/623, 625

[56] References Cited

U.S. PATENT DOCUMENTS 3,531,853 10/1970 Klomp .
4,011,480 3/1977 Jacobs et al. ..... 313/625 X
4,160,930 7/1979 Driessen et al. .
4,545,799 10/1985 Rhodes et al. .
4,766,347 8/1988 Janssen et al. .
4,808,881 2/1989 Kariya et al. ..... 313/625 X

FOREIGN PATENT DOCUMENTS 2326034 4/1977 France .
1152134 5/1969 United Kingdom .

*Primary Examiner*—Sandra L. O'Shea
*Attorney, Agent, or Firm*—Frishauf, Holtz, Goodman & Woodward

[57] ABSTRACT

A high-pressure discharge lamp with a ceramic discharge vessel (8) comprises a tubular current feedthrough (10) of a metal whose thermal coefficient of expansion is smaller than that of the ceramics. Gastightness is obtained by an internal support member (16) located within the current feedthrough (10).

20 Claims, 5 Drawing Sheets

HIGH-PRESSURE DISCHARGE LAMP

REFERENCE TO RELATED APPLICATION

U.S. Ser. No. 07/912,526, filed Jul. 13, 1992, Bunk, Jungst, Maekawa and Werner.

Reference to related patents, the disclosure of which is hereby incorporated by reference:

U.S. Pat. No. 4,545,799, Rhodes et al
U.S. Pat. No. 4,011,480, Jacobs et al
U.S. Pat. No. 4,160,930, Driessen et al
U.S. Pat. No. 3,531,853, Klomp

FIELD OF THE INVENTION

The present invention relates to a high-pressure discharge lamp, and more particularly to a high-pressure discharge lamp having a ceramic vessel which contains an ionizable filling and has two ends which are each closed by a ceramic plug in which is positioned a tubular current feedthrough of a metal whose thermal coefficient of expansion is smaller than that of the ceramics.

It relates, for example, to high-pressure sodium lamps, more specifically, however, to metal halide lamps with improved color rendition. The use of a ceramic discharge vessel permits the operation at the higher temperatures required for this. Typical wattage ratings are 100 W to 250 W. The ends of the tubular discharge vessel are closed by cylindrical ceramic end plugs which have a metallic current feedthrough in an axial opening thereof.

BACKGROUND

Customarily, feedthroughs of niobium are used (as described in the German Patent Specification DE-PS 1 471 379). These feedthroughs, however, are only relatively suitable for lamps having long lives and good color rendition, since, especially when lamps have a metal halide fill, the niobium tube and the ceramic sealing material used for the seal corrode considerably. An improvement is described in the U.S. Pat. No. 4,545,799, Rhodes et al. The niobium tube is tightly sealed in the plug without ceramic sealing material due to the shrinking process of the "green" ceramics during the final sintering. This is readily possible as both materials have approximately the same coefficient of thermal expansion ($8\times10^{-6}\ K^{-1}$).

Feedthroughs made from other metals have also been tested.

A feedthrough is known from the U.S. Pat. No. 3,531,853, Klomp, which has a surface of platinum, iron, nickel or cobalt and a core of an alloy that is adapted to the ceramics. The feedthrough may have a conical shape and may be joined to the plug by the use of a ceramic internal support member—with both plug and internal support member also having conical shape—by axial pressing at a defined pressure and in a defined gaseous atmosphere.

Discharge lamps are known from the U.S. Pat. Nos. 4,011,480, Jacobs et al, and 4,160,930, Driessen et al, in which the tubular current feedthrough consists of tungsten, molybdenum or rhenium, with the tube being supported in the interior thereof by a ceramic cylinder having straight, axially aligned walls. The cylinder may be solid or hollow; in the latter case the bore serves as the exhaust plug and is subsequently closed. The seal between the feedthrough and the internally and externally abutting ceramic parts, which have both been finally sintered earlier at a temperature of 1850° C., however, is still carried out by means of a ceramic sealing material so that the susceptibility to corrosion of these lamps has indeed been reduced but does not yet satisfy the requirements for the use in lamps having metal halide fills. In spite of great efforts it has not been possible hitherto to develop a corrosion resistant ceramic sealing material.

THE INVENTION

It is an object of the invention to provide a feed through which is resistant to changes of temperature and corrosion and which can be used, more particularly, with halide containing fills.

Briefly, a ceramic discharge vessel, which contains an ionizable metal halide fill, has two open ends. Each one of the open ends has a current feedthrough directly sintered to a plug fitted into the open end. At least one of these feedthroughs is tubular and an internal support element is located within the tubular feedthrough.

The invention is based on a further development of the technology described in copending U.S. application Ser. No. 07/912,526, filed Jul. 13, 1992, Bunk et al (to which Published European Application 0528 428 A1, based on filed application 91 113 912.9 corresponds. This application describes thin-walled molybdenum tubes (wall thickness 0.05 0.25 mm) into ceramic plugs directly. When these plugs are used in lamps having particularly good color rendition, a narrow gap will result between the current feedthrough and the plug after about 500 temperature cycles (that is, switching-ON and switching-OFF of the lamp, each causing a change in temperature). The width of this gap is about 15 μm. This is due to the great difference (25%) between the coefficients of thermal expansion of molybdenum ($6\times10^{-6}\ K^{-1}$) and ceramics ($8\times10^{-6}\ K^{-1}$) which makes itself felt due to the change in temperatures.

The invention uses the shrinking process of a green ceramics also for the bond between the plug and the non-adapted feedthrough, and thus avoids the use of the corrosion susceptible ceramic sealing material additionally, it uses an internal support member in the form of an already finally sintered ceramics which is no longer subject to a shrinking process. This internal support member and plug preferably consist of the same ceramic material. Due to the cooperation of these two measures the life of these lamps is considerably extended (by up to a factor four).

The bond is obtained by first leaving the end plug as a green body in which the tubular current feedthrough, which includes the internal support member, is positioned. The plug is now finally sintered, and the, necessary reliable bond is achieved due to the shrinking of the end plug (about 2–20%). The shrinking green body of the end plug presses on the tube and presses the latter against the internal support member. The temperatures required for this (about 1850° C.) will not nearly be attained (about 1100° C.) at the end plug during operation of the lamp.

This way of joining is particularly advantageous with halide containing fills, since corrosion susceptible components are completely omitted.

In the event that the tubular current feedthrough is gas-tightly closed on the side facing the discharge, it may be possible to use the known ceramic sealing material technology for the joint between the internal support member and the tube, because, in this case, no halide will get to the ceramic sealing material. It must be taken into consideration that only ceramic sealing materials are suitable which have a melting point higher than the sintering temperature. It has become evident that metallic solders can also be used. The latter have a higher elastic elongation and are thus more readily capable of joining bodies having different coefficients of thermal expansion.

In the case of a current feedthrough which is open on the side facing the discharge, that is, a feedthrough which is not gas-tightly closed, the ceramic sealing material is omitted when joining the internal support member to the feedthrough tube. The idea is to provide for the tightness on the inside of the current feedthrough by the pressure of the plug on the outside thereof.

In both cases a relatively precise fit of the internal support member is necessary (about 15–50 μm if a ceramic sealing material is used, it must be introduced by a capillary effect; with direct sintering, the precise fit is necessary to obtain reliable tightness even when the shrinking is only slight (about 2%).

In the most simple embodiment the internal support member has the form of a solid cylinder or of a cylindrical tube (hollow cylinder). In the latter case the central bore serves for exhausting and filling purposes. It can later be closed by a ceramic sealing material or the like.

One embodiment has proved particularly suitable, especially when the internal support member, too, is secured within the tube without ceramic sealing material or metal solder. In this embodiment, the height of the internal support member is smaller than the height of the plug. A typical value is a reduction by 30%. During the final sintering of the end plug with the feedthrough tube positioned therein, the portions of the feedthrough extending beyond the internal support member are still further pressed together since, here, the resistance of the internal support member does not exist, so that there results a particularly reliable tight joint at least at one end of the internal support member and, in addition, the internal support member is reliably retained. The central positioning of the internal support member with respect to the plug height is particularly suitable because, in this case, the securing effect occurs at both ends of the internal support member.

Particularly advantageous is an embodiment in which at least a portion of the internal support member tapers into a conical shape. This shape considerably facilitates the matching of the parts to be joined (plug-tube-internal support member), as differences in diameters are automatically compensated for by axial displacement. The initial fit needs to be precise only to about 200 μm. In addition, the retention of the internal support member in the tube is automatically safeguarded prior to the joining thereto. This embodiment is especially well suited for the joining technique without ceramic sealing material.

The manufacture of this particularly well suited embodiment can be carried out in two ways. The tube itself may already have a conical portion, with the angle of inclination of internal support member and tube being the same (typically about 10° ). Or, the internal support member alone can originally be slightly conical (5°–10° ) either entirely or over a portion thereof. In this case, the originally circular cylindrical tube is first pressed to a conical shape. This is carried out preferably by friction welding by drawing the tube onto the internal support member while the tube is continuously rotated. For facilitating this technique or for obtaining larger angles, the tube can already be preshaped so as to be slightly conical (typically 5° ) and can be additionally enlarged during friction welding (to typically 10°). This unit is then inserted into the conically preshaped green body of the end plug and the end plug is finally sintered.

With the friction welding, care must be taken that due to the friction the tube is brought to a temperature which is above the transition from the brittle phase to the ductile phase so that the tube can be elastically deformed. The temperature of the transition is particularly low in the case of molybdenum (200° C.). For this reason molybdenum is preferred over tungsten and rhenium for this technique which provides a particularly reliable bond between the internal support member and the current feedthrough. In tile other embodiments tungsten and an alloy of tungsten and rhenium are suited similarly well as molybdenum. Their coefficient of thermal expansion ($4\times10^{-6}K^{-1}$) is even smaller than that of molybdenum. To summarise, it may be noted that the present invention is applicable to a feedthrough whose coefficient of thermal expansion is at least 20% smaller than that of the ceramic formed parts.

The invention provides a high-pressure discharge lamp of long life whose tightness is not impaired even by the use of halide containing fills. The discharge vessel is customarily tubular, either cylindrical or with an outwardly bulging portion at the middle thereof. Frequently it is located within a single-ended or double-ended outer envelope.

The referenced application Ser. No. 07/912,526, filed Jul. 13, 1992, describes a feedthrough system which is capable of resisting corrosion and changes of temperature and which can be used, more particularly, for lamps having a metal-halide containing fill.

Metals having a low thermal coefficient of expansion (molybdenum, tungsten and rhenium) are the metals which have a high corrosion resistance against aggressive fills. Their use as a current feedthrough is, therefore, highly desirable. However, the problem of providing a gas-tight seal while using such feedthroughs has remained unsolved in the past.

Metals such as niobium and tantalum have thermal coefficients of expansion that match those of the ceramic; on the other hand, however, they are known for having poor corrosion resistance against aggressive fills and they have not yet been available for use as a current feedthrough for metal halide lamps.

At least the portion of the feedthrough which is exposed to the aggressive fill in the interior of the discharge vessel is made of a corrosion resistant material having a low thermal coefficient of expansion, that is, a coefficient of expansion which is at least 20% lower than that of the ceramic vessel material.

A very simple and basic embodiment of the invention uses a continuous tubular feedthrough of molybdenum which is tightly sintered directly into the ceramic plug without using any ceramic sealing material.

The feedthrough is bonded directly into the plug only by co-firing. This is very surprising insofar as it was hitherto believed that a durable direct sintering could only be effected by using materials having approximately the same thermal coefficient of expansion as the ceramic, such as is the case with niobium.

It has become evident that a similar method can only be used with molybdenum, tungsten or rhenium (thermal coefficient of expansion $\leqq 6\times10^{-6}\ K^{-1}$) if it is modified accordingly. This permits manufacture of a bond which is material-locking, free from cracks and fissures, and which can be used with less agressive fills and relatively low thermal strain.

It is advantageous that the tubular current feedthrough has very thin thickness, a small diameter, and a toughened surface. It is further advantageous that the relation between the inside diameter of the plug, facing the feedthrough, and the outside diameter of the feedthrough is within certain optimum dimensions. The seal made without any ceramic Sealing material is obtained by first leaving the end plug as a green body into which the current feedthrough is introduced. In the final sintering of the plug which will now take place, the required reliable bond of the plug and current feedthrough interface will be achieved due to the shrinking process of the end plug in which the shrinking green body of the end plug finally is firmly forced onto the current feedthrough.

An important parameter of the present invention is that the current feedthrough is not a solid cylinder but a tube having a sufficiently thin wall in order to be able to deform slightly to compensate for the force acting on the feedthrough caused by the shrinking of the end plug during the final sintering. On the other hand, the current feedthrough tube must be sufficiently thick in order to be able to warrant mechanical stability and, more particularly, to be able to securely retain-the shaft of the electrode. A wall thickness of 0.1 to 0.25 mm has proved especially suitable.

A second important parameter is the diameter of the current feedthrough which determines the absolute value of the thermal expansion. The smaller the diameter is in actual fact, the smaller are the forces of expansion occurring during operation of the lamp. Preferably, the outer diameter is smaller than 2.0 mm. On the other hand, for most practical purposes, and to be able to carry enough current, a minimum inner diameter of 0.5 mm is recommended, although a smaller diameter may be used for certain low-wattage lamps.

A third important parameter is the surface roughness of the feedthrough. The direct sealing between the feedthrough and the plug appears to be due mainly to a mechanical bond and to a lesser degree to a diffusion bond. The larger the contacting areas at the interface of feedthrough and plug, the more effectively can be attained the gas-tightness-of the direct sealing portion. Preferably, the surface roughness of the feedthrough is about 10–50 μm by Ra, which means a center-line average surface roughness.

A roughness of less than 10 μm is not effective to the improvement of gas-tightnes. A roughness larger than 50 μm, although suitable for producing a discharge vessel body with good gas-tightness, is not preferable because it decreases the reliability and mechanical stability of the current feedthrough. This toughening can be simply done by means of various ways such as sand blasting, chemical etching and machining.

A fourth important parameter is the selection of the optimum relation between the inside diameter of the end plug and the outside diameter of-the current feedthrough. Prior to sintering, the end plug is in an unsintered or so-called "green" state. Upon sintering, the end plug shrinks, with both its outside and inside diameter decreasing. If the decrease of the plugs inside diameter during shrinking is much too high, cracking of the end plug is caused due to the bounding stress from the current feedthrough introduced into the plug's inside hole. If it is too low, the bonding force at the interface between the end plug and current feedthrough becomes weak and it results in the of gas-tightness of the discharge vessel. Preferably, the inside diameter of the end plug—if sintered without introducing the current feedthrough—would be 5 to 10% less than the unvaried outside diameter of the current feedthrough.

In carrying out this technological process, the seal is obtained by first positioning the current feedthrough into the axial hole of the plug while the plug is in the green state. One of the assemblies thus obtained is inserted in each end of the tubular vessel in the green state, and the said inserted assembly is sintered in hydrogen or in a vacuum atmosphere at a temperature of about 1850° C. for 3 hours. The required reliable seal at the plug feed through interface is achieved due to the shrinking process of the plug in the green state during sintering in which the shrinked end plug body finally is firmly bonded onto the current feedthrough.

When tubes are used as a feedthrough which are made exclusively of molybdenum, and when the discharge vessels are subjected to very great strain, for example, in the case of lamps having excellent color rendition, and the temperature of its coldest spot is higher than 700° C., a gap may form between the current feedthrough and the plug after about 500 temperature cycles. (or changes of temperature subsequent to the switching on and off of the lamp). The width of such a gap is about 3 μm. This gap occurs as a result of the large difference between the low thermal coefficient of expansion ($6\times10^{-6}$ $K^{-1}$) of the molybdenum and the high coefficient of expansion Of the ceramic ($8\times10^{-6}$ $K^{-1}$) which has an effect caused by the strain from the temperature changes and it may result in lamp failure.

This basic technology can be modified.

A first technical modification is to use a modified plug which consists of a composite material having a coefficient of thermal expansion between those of the ceramic vessel material and of the tubular metallic feedthrough material. The tubular feedthrough, e.g. of molybdenum, is gas-tightly sintered directly into the plug of composite material, which comprises, for example, alumina and tungsten, without using any ceramic sealing material. This co-fired body maintains gas-tightness after more than 500 numbers of heat cycles between 20° C. and 900° C. It is possible to apply a hydrogen atmosphere for co-firing of an assembled body which consists of a metallic feedthrough, a plug of composite material and the ceramic discharge vessel.

A first important parameter of this technology is to use a tubular-feedthrough of molybdenum, tungsten, rhenium or alloys thereof. If the feedthrough were a solid, for example, a rod or wire, cracking would occur at the direct-bonded portion. It is preferable to use a tube of small outside diameter. Preferably, the outer diameter is smaller than 2.0 mm. The thickness of the tube is not limited especially, however, to permit the shrinking force caused under the firing process to prevent cracking, the inside diameter of the tube should be at least more than 0.3 mm.

A second important parameter is the plug material. It must have a coefficient of thermal expansion between those of a metallic current feedthrough and the ceramic discharge vessel and a good corrosion resistance against any agressive fill component such as metal halides and sodium. Furthermore, is more desirable to select such a material whereby it is possible to co-fire an assembled body under a hydrogen atmosphere. The assembled body consists of a metallic feedthrough, a ceramic vessel and a plug formed by such a composite material.

The plug material consist of two components. Alumina is cite main and indispensable first component. The second component comprises one or more materials selected from the metals tungsten, molybdenum and rhenium, or graphite or ceramics having a low coefficient of thermal expansion such as AlN, TiC, $Si_3N_4$, SiC, ZrC, $TiB_2$, and $ZrB_2$. The ratio of the two components is the following: the proportion of the main component alumina is 60 to 90% by weight, and the proportion of the second component is 10 to 40% by weight. The respective coefficients of thermal expansion of these composite materials are about 5.5 to $6.5\times10^{-6}$ $K^{-1}$. The reason why alumina has to be an indispensable component is not only its excellent corrosion resistance. Furthermore, due to a solid diffusional reaction under firing at a temperature of about 1800° C., the seam originally located at the contacting zone between the plug and the end of the discharge vessel is eliminated and thus a quasi one-bodied structure is formed. The proportion of alumina should be at least 60% by weight. If this proportion is higher than 90% by weight, the composite material does not have a desirable coefficient of thermal expansion, and, as a result, the direct-bonded portion between the plug and the metallic feedthrough is unable to maintain the gas tightness after numbers of heat cycles, which finally results in lamp failure. If the proportion the second component, especially due to the metal included therein, is too high, it is very difficult to sinter the plug and to make a highly densified dispersion of composite material which is needed to guarantee the gas-tightness of the plug itself. For example, in case of a composite material consisting only of alumina and tungsten (or one or more of the above mentioned metals), a ratio of alumina: tungsten =70 to 83: 30 to 17 by weight shows the best results with respect to gas-tightness. For other second component materials, the most favorable proportion is within 10 to 25% weight. This applies especially to the ceramic materials or blends of ceramic and metallic materials. A preferred example is a plug with 20% SiC, balance $Al_2O_3$.

These composite materials can be manufacture nearly without special conditions. Basically the procedure is the following: weighing the desired proportion of alumina powder and of the second component; adding some auxiliary pressing agents for forming, such as water, alcohol, organic binder etc.; mixing them by a ball-mill or kneader; making a granular powder suitable for the fabrication process by means of a spray-dryer and/or in any other way, and finally shaping a plug provided with an axial hole for positioning a current feedthrough therein. One special condition must be kept in mind: apart from alumina and SiC, the materials for the second component oxidize and decompose comparatively easily. Therefore, it is necessary to carefully select both the suitable auxiliary agents for forming and optimum conditions such as atmosphere and temperature at the pre-firing process, which removes the auxiliary agents which have been introduced for forming the green body to a plug shape, and to prevent oxidation and/or decomposition of the second component materials. Otherwise the result would be an undesired coefficient of thermal expansion and/ or the occurrence of cracking in the plug body itself.

A third important parameter is the surface roughness of the metallic feedthrough. It is favorable to use a metallic feedthrough having a toughened surface, but this is not as important as the other parameters because it is possible to maintain a gas-tightness at the direct-bonded region between plug and feedthrough, even if the feedthrough is not specially prepared.

A fourth important parameter is the optimum relation between the feedthrough and the plug on the one hand and between the plug and the ceramic vessel on the other hand. The conditions which make a ceramic discharge vessel have a direct-bonded closure, obtained by only co-firing, at one or both of its ends are almost the same as in the basic technology: The axial-hole diameter of the plug where a metallic current feedthrough is positioned passing through the hole and being directly bonded to it by co-firing has to be adjusted so that after shrinking it would be 3 to 10% less than the original outer diameter of a metallic feedthrough, if the plug Were fired without a metallic feedthrough. A similar condition applies to the inner diameter of the end portion of the ceramic discharge vessel, in which end portion the plug is inserted and a one-bodied structure is created by applying a solid diffusional reaction under co-firing. This inner diameter has to be adjusted so that after shrinking it would be within a range of 2 to 5% less than the outside diameter of the plug if only the vessel were fired. The reason for those conditions is the same as that of the basic technology.

DETAILED DESCRIPTION

Figure 1:
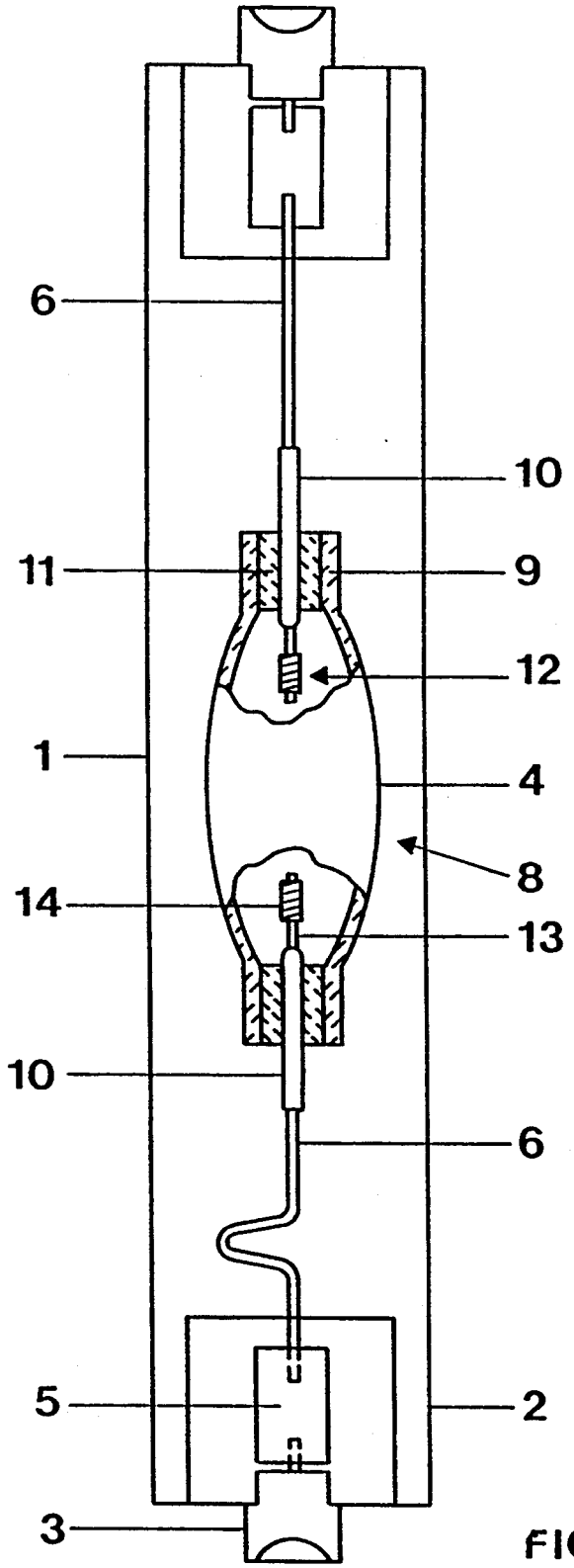

FIG. 1 illustrates schematically a metal halide discharge lamp of 150 W power rating. It comprises a cylindrical outer envelope 1 of hard glass defining a lamp axis, the envelope being pinch-sealed 2 and provided with a base 3 at each of its ends. The axially aligned discharge vessel 8 of alumina ceramics is outwardly bulging at the middle portion 4 and has cylindrical ends 9. It is supported in the outer envelope 1 by means of two current supply conductors 6 which are connected to the bases 3 via foils 5. The current supply conductors 6 are welded to tubular feedthroughs 10 which are each fitted in a plug 11 at the end of the discharge vessel.

The two feedthroughs 10 of molybdenum (or tungsten, possibly alloyed with rhenium) each support an electrode 12 at the discharge side thereof. The electrode comprises an electrode shank 13 and a coil 14 slipped on the shank at the side facing the discharge. The fill of the discharge vessel comprises an inert starting gas such as argon, mercury, and additives of metal halides.

Figure 2:
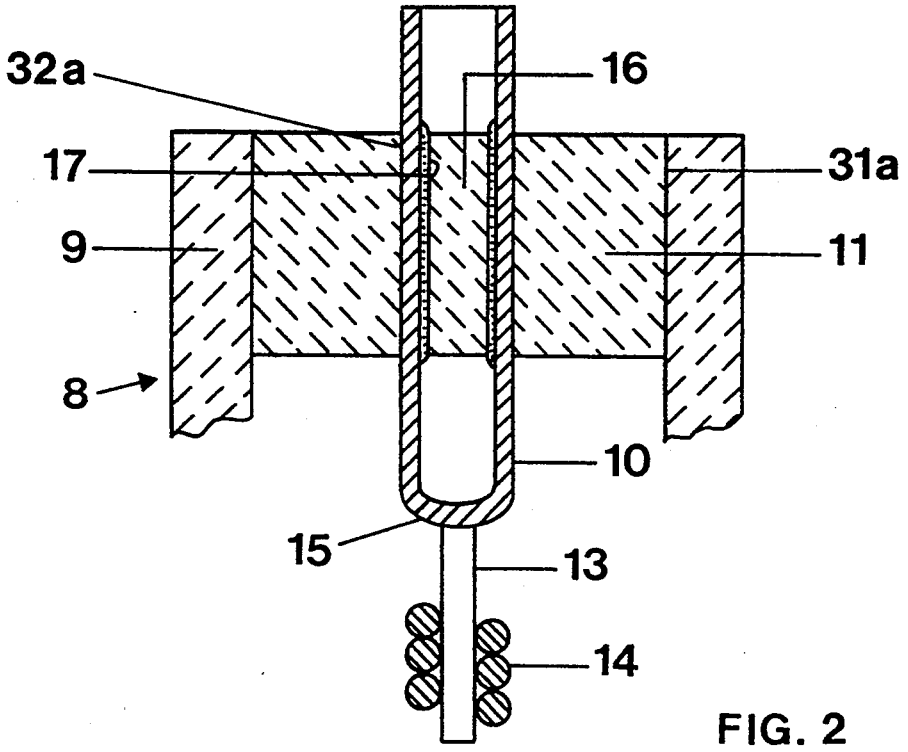

FIG. 2 illustrates the sealing region at one end of the discharge vessel 8 in detail. The discharge vessel 8 has at its two ends 9 a wall thickness of 1.2 mm. A cylindrical plug 11 of alumina ceramics is inserted into the end 9 of the discharge vessel. Its outer diameter is 3.3 mm, its height 5 mm. A molybdenum tube 10, which has a length of 12 mm, a wall thickness of 0.1 mm, a constant diameter of 1.4 mm and which is closed at the end 15 facing the discharge, is fitted in an axial opening in the plug as a feedthrough. The shank 13 is welded onto the end 15.

The tube 10 extends on both sides beyond the plug 11. A ceramic internal support member 16 of alumina is located in the interior of the closed tube 10 at the height of the plug. The internal support member is a solid cylinder whose outer diameter is closely matched (to about 15 μm) to the inner diameter of the tube 10. The solid cylinder is joined to the tube by an intermediate metal solder layer 17. In contrast, no additional joining agent is located between the tube 10 and the plug 11 that is, the system of feedthrough 10 and plug 11 is devoid of joining or sealing material. The plug 11 is directly sintered onto the tube 10.

The direct sintering of the integral current feedthrough into the plug is carried out as follows:

The present process for producing a discharge vessel 8 with cylindrical ends 9, provided with a plug 11 and an integral current feedthrough 10 which is directly sealed into the axial hole of the plug, comprises preparing a current feedthrough provided with an electrode system 12, said feedthrough being made from a molybdenum tube of which the inside diameter and thickness are 1.0 mm and 0.2 mm respectively. Further, the process comprises providing two kinds of mixtures of inorganic powders as a starting material, so-called dispersions, composed of alumina and doping material such as $Y_2O_3$ and/or MgO, one-of said dispersions applying for the vessel body and the alumina used for this dispersion having a specific surface area ranging from about 5 $m^2/g$ to about 10 $m^2/g$, said other dispersion applying for the plug body and the alumina used for this dispersion having a specific surface area ranging from about 3 $m^2/g$ to about 5 $m^2/g$. Said dispersions are formed into two kinds of green bodies (vessel- and plug-shaped).The difference in linear shrinkage ($\Delta L/Lo(\%)$), which is the difference in length between the green body and the sintered body, $\Delta L$, divided by the length-of the green body, Lo, between said two green bodies is preferably about 3 to 5%. For example, said vessel-shaped green body has a linear shrinkage of 21 to 24% and said plug-shaped green body has a linear shrinkage of 17 to 20%. The bonding portion 9 of the vessel-shaped body has an inside diameter of 4.00 mm and the plug-shaped green body has an outside diameter of 3.96 mm, a height of 6.0 mm and an axial hole diameter of 1.56 mm. The process further comprises prefiring or presintering the said bodies in an air atmosphere at a temperature ranging from about 1000° C. to about 1400° C. to eliminate impurities including shaping aids and water, positioning the current feedthrough 10 into the axial hole of said preferred plug body, inserting said positioned body into a bonding portion in each end of said prefired vessel body, and sintering said assembled body in an atmosphere of hydrogen or in vacuum at a temperature ranging from about 1750° C. to about 1900° C. for 3 to 5 hours producing a sintered discharge vessel body directly sealed current feedthrough, said discharge portion of the body having an optical translucency which light or radiation in the visible wavelength is able to pass through sufficiently, said bonding portions inside diameter of the vessel body shrinking more than the outside diameter of the plug body, and-also said axial hole diameter of the plug body shrinking more than the outside diameter of the current feedthrough, but said bonding portion of the vessel and direct sealing portion of the plug slightly-deforming about the plug and the current feedthrough as is known in the prior art, and resulting in said sintered body having a perfect gas-tightness at the interfaces of the vessel to plug bonding portion 31*a* and at the plug to current feedthrough direct sealing portion 32*a*.

In preferred embodiment, the example is slightly modified in that a cylindrical plug 11 of composite material is used, consisting of alumina and tungsten of respectively 80% and 20% by weight. The dimensions are the same as already discussed above. The manufacturing process is essentially the same as discussed above with the following exceptions. The dispersion applying for the plug body is composed of alumina and tungsten, the alumina having a specific surface area of about 3 to 5 $m^2/g$ and the tungsten having an average particle size of less than one micron, the weight ratio of said alumina/tungsten being 80/20. It has to be pointed out that such a composite body cannot be considered as a cermet because it does not have the typically small resistance of a cermet, For example 20 mΩ. On the contrary, the resistance air the composite body is advantageously very high (typically, $10^{10}\Omega$), so that the composite body is nonconducting and hence the undesired back-arcing after ignition is avoided. Again, the two dispersions are formed into two kinds of green bodies (vessel- and plug-shaped). The difference in linear shrinkage and the dimensions also can be the same as discussed above. In contrast to the basic example, only the vessel-shaped body is prefired in air atmosphere at a temperature of about 1,000° C. to 1,400° C. to eliminate impurities including shaping aids and water. On the other hand, said plug-shaped body is prefired in air atmosphere at a temperature of less than 300° C. to prevent the oxidation of the tungsten component and to remove shaping aids and water prior to the real presintering in a hydrogen atmosphere at a temperature of 1,200° C. to 1400° C. By this real presintering, the axial hole diameter of the plug-shaped body shrinks to about 1.45 min.

The process further comprises, as already discussed, positioning the current feedthrough 10 in the axial hole of the said presintered plug body, inserting the said positioned body into a bonding portion in each end of the prefired vessel body, and sintering the assembled body in an atmosphere of hydrogen or in vacuum at a temperature of about 1750° C. to 1900°C. for 3 to 5 hours. The resulting gas-tightness of the bonding portion 31*a* and sealing portion 32*a* is especially good.

Figure 3:
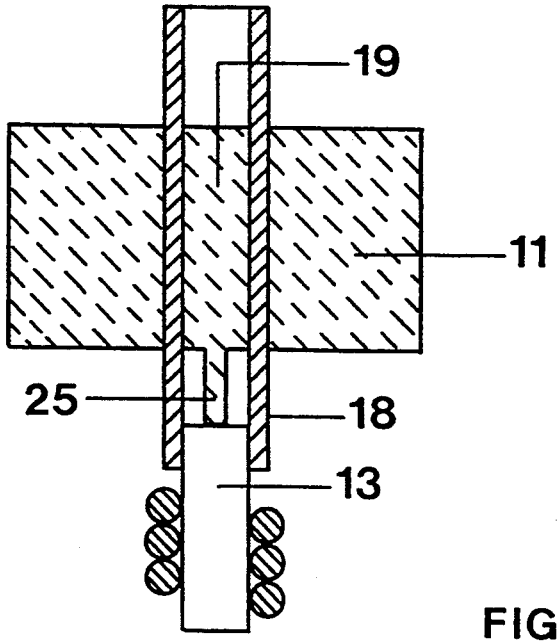

In another embodiment which is shown schematically in FIG. 3, the plug 11 is also sintered onto the tube 18. The tube 18 is gas-tightly closed on the side facing the discharge in that the electrode shank 13 is welded into the open end of the tube 18. The internal support member 19, whose height is approximately the same as the height of the plug, is tightly fitted into the tube 18—the tolerance being about 50 μm—and thus forms an opposition during the shrinking process of the plug 11 which ensures a strong, gas-tight contact between tube 18 and internal support member 19.

In order to facilitate the positioning of the internal support member in the feedthrough, a stop for the internal support member may be used. This can be, in the simplest case, an annular spring element of refractory material which is placed in the cylindrical tube. As shown in FIG. 3, an extension 25 of the internal support member serving as a spacing member which rests on the shank 13 of the electrode is particularly suitable.

Figure 4:
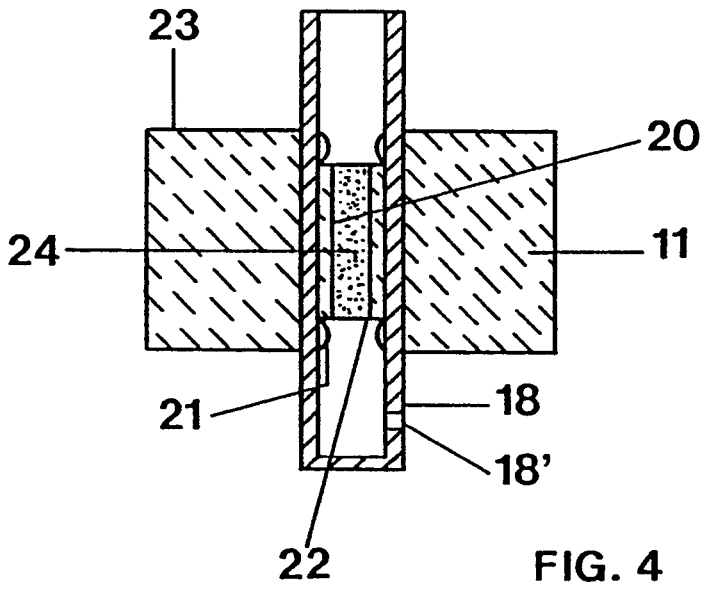

In a modified version of this embodiment (FIG. 4) the tightness is further improved in that the internal support member 20 is formed as a hollow cylinder and has a height of 3.5 mm which is shorter than the height of the plug 11, with the hollow cylinder being located at about the middle with respect to the height of the plug. During the shrinking process of the plug, inwardly extending bulges 21 are formed in the tube 18, which bulges extend from the edges 22 of the internal support member to the height of the front faces 23 of the plug. The reason for this is that there is no resistance of the internal support member during the shrinking of the plug ceramics in these regions. The bulges are shown at an enlarged scale since, in reality, they can hardly be seen with the naked eye. The seat of the plug and the tightness of the feedthrough 18 both on its outside and on its inside are thus additionally improved.

In this version the hollow cylinder 20 can be used as an exhaust chuck if the tube 18 is formed with an opening 18'. After evacuation and filling, the hollow cylinder 20 is closed by a suitable ceramic sealing material 24 in well known manner.

Figure 5:
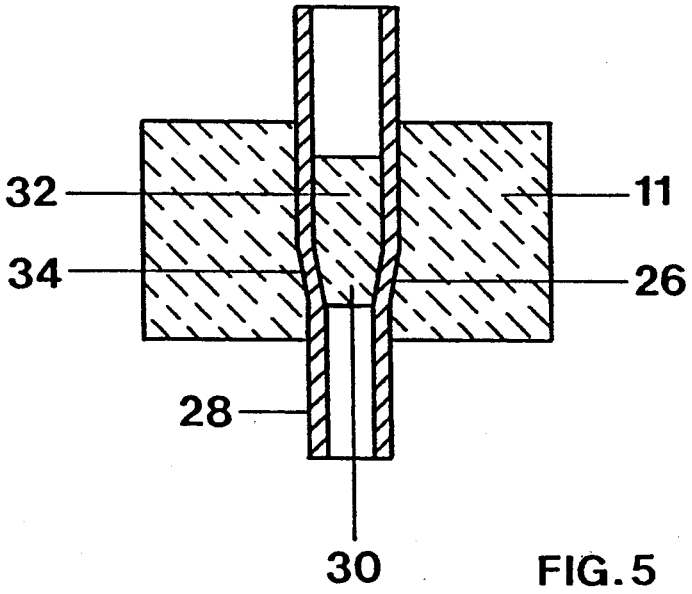
Figure 6:
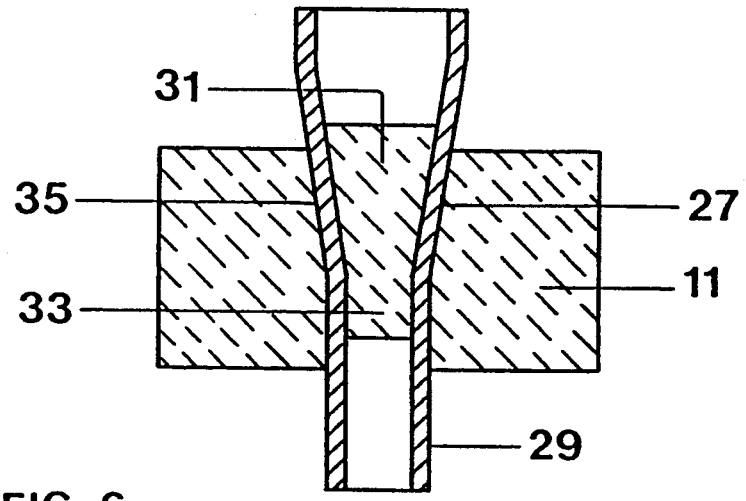

A further possibility which can be used more specifically with an internal support member whose length is reduced with respect to the length of the plug is shown in FIGS. 5 and 6. The stop is formed by a conical central portion 26, respectively 27, of the tube 28, respectively 29, at which a corresponding conical end portion 30, respectively 31, of the internal support member 32, respectively 33, abuts lit does not matter whether the conical portion is located on the side facing the discharge (FIG. 5) or on the side facing away from the discharge (FIG. 6) of the feedthrough. In both cases, the plug 11 is also provided with the respective inclined portions 34, 35. With these partly conical variants, the internal support member 33 may be offset with respect to the plug towards the side remote from the discharge, or may even project beyond the front face of the plug. The securing of the internal support member can be carried out in accordance with both the techniques shown heretofore (FIGS. 2, respectively 3).

Figure 7:
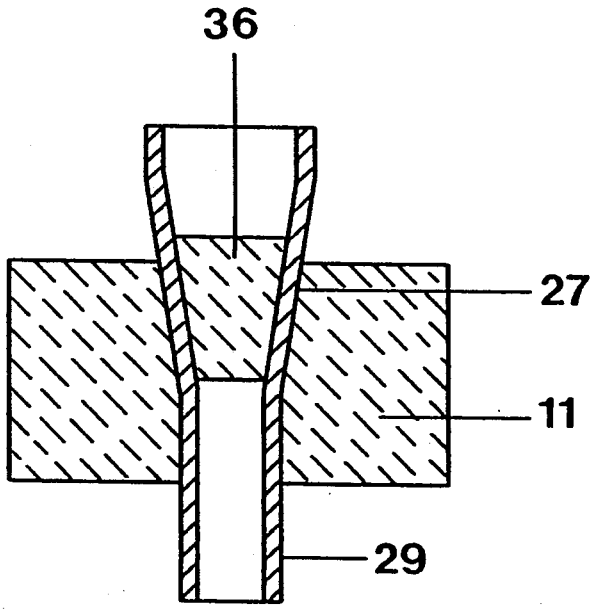
Figure 8:
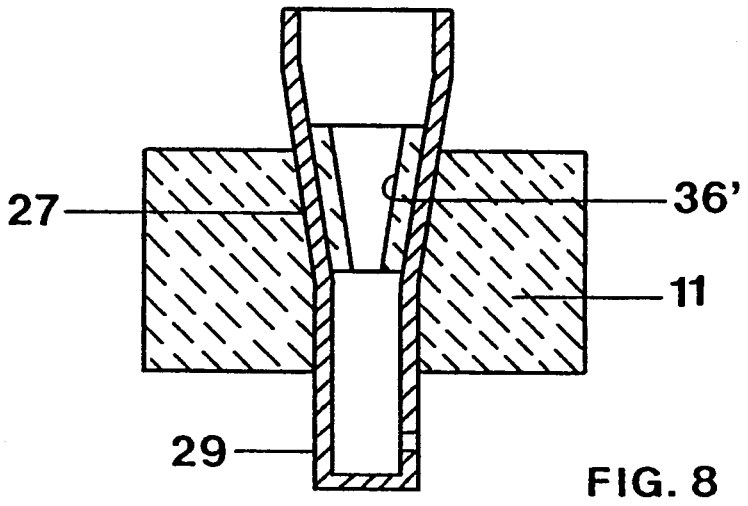
Figure 9:
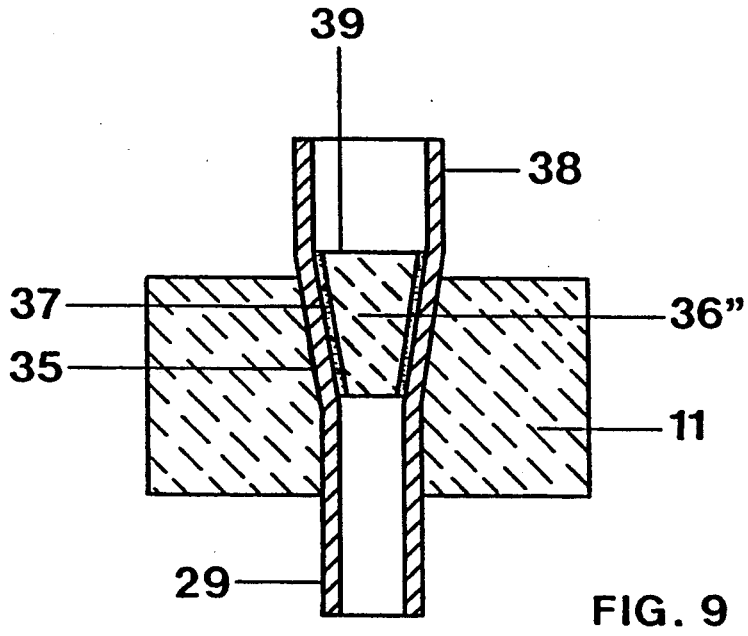

Embodiments having particular advantages are shown in the FIGS. 7 to 9. An entirely conical internal support member is inserted in the conical central portions 27 of the tube 29, offset towards the side remote from the discharge.

The internal support member can again be solid (FIG. 7) as a truncated cone 36, or tubular with conical inner walls (36' in FIG. 8) or also with straight inner walls (36'' in FIG. 9). By such an arrangement, the advantages of a stop may be ideally combined with the reduced requirements for the tolerances to be observed.

The embodiment of FIG. 9 satisfies the extremely high requirements relating to tightness and, thus, long life. It corresponds substantially to the examples of FIGS. 7 and 8; however, here, a particularly reliable, joint between molybdenum tube 29 and conical internal support member 36'' has been effected by friction welding. During this process, a joining layer 37 having a thickness of but a few atom layers (shown exaggeratedly thick in FIG. 9 for the purpose of illustration) is formed between molybdenum tube and internal support member. The angle of inclination of the cone is here smaller than 10°, in order to keep the mechanical deformation of the originally straight molybdenum tube 29 as slight as possible. The inclined portions 3S of the plug have the same inclination. The end portion 38 of the tube with the enlarged diameter begins, in accordance with the method of manufacture, immediately at the base end 39 of the internal support member.

The technique of the friction welding may also be used with the partly conical embodiments.

We claim:

1. A high-pressure discharge lamp having a ceramic discharge vessel (8) having two ends;

a ceramic plug (11) formed with an opening within each of said two ends;

a metallic feedthrough (10; 18; 28; 29) passing through and fitting into the respective opening of each one of said ceramic plugs, wherein the metal of the feedthrough has a thermal coefficient of expansion which is less than that of the ceramic of the plug; and an ionizable metal-halide fill within said discharge vessel (8), and wherein, in accordance with the invention, said metallic current feedthroughs (10; 18, 28, 29) and the respective plugs (11) consist of a sinter connection between the opening of the plug and the outside of the feedthrough fitted into said opening, and form a gas-tight connection devoid of sealing material between the outside of said feedthrough and the opening of the plug;

at least one of said current feedthroughs (10; 18, 28; 29) is hollow; and a ceramic internal support member (16; 19; 20; 32; 33; 36) is provided, located within the interior of said at least one hollow current feedthrough and positioned therein at least in part approximately at a level where the hollow current feedthrough passes through the respective plug (11).

2. The high-pressure discharge lamp as in claim 1, wherein the internal support member (16; 19; 20; 32; 33; 36) has an outer diameter which is less than the inner diameter of the at least one hollow tubular lead through by between about 15–50 $\mu$.

3. The high-pressure discharge lamp as in claim 1, wherein the current feedthrough essentially consists of molybdenum or of tungsten or of rhenium, or of an alloy of tungsten and rhenium.

4. The high-pressure discharge lamp as in claim 1, wherein said current feedthrough essentially consists of molybdenum, or of a molybdenum alloy.

5. The high-pressure discharge lamp as in claim 1, wherein the internal support member (16) is positioned at least approximately at the level of said plug (11).

6. The high-pressure discharge lamp as in claim 1, wherein the ceramic material of said internal support member and of said plug (11) is alumina ceramics.

7. The high-pressure discharge lamp as in claim 1, wherein said internal support member is a sintered ceramic.

8. The high-pressure discharge lamp as in claim 1, wherein the ceramic material of said internal support member and said plug (11) alumina ceramics.

9. The high-pressure discharge lamp as in claim 7, wherein the plug (11) is a sintered ceramic providing opposition to radial forces acting on said hollow current feedthrough.

10. The high-pressure discharge lamp as in claim 1, wherein the internal support member (19; 20; 31; 32) is coupled to the hollow current feedthrough (18; 28, 29) solely by the pressure of the plug (11) on the hollow current feedthrough directly sintered into the plug (11).

11. The high-pressure discharge lamp as in claim 1, wherein the current feedthrough (10) is closed (15) on the side facing the interior of the vessel; and the internal support member (16) is coupled to the current feedthrough (10) by a ceramic sealing material (17) or a metal solder.

12. The high-pressure discharge lamp as in claim 1, wherein the internal support member is formed as one of: a solid cylinder (19), and as a hollow cylinder (20).

13. The high-pressure discharge lamp as in claim 1, wherein the height of the internal support member (20) is smaller than the height of the plug (11).

14. The high-pressure discharge lamp as in claim 13, wherein the internal support member (20) is located within the current feedthrough (18) substantially centrally with respect to the height of the plug (11).

15. The high-pressure discharge lamp as in claim 1, wherein at least the outer wall of the internal support member comprises a conical portion (30; 31; 36; 36; 36″) tapering towards the interior of the discharge vessel, and the hollow current feedthrough has conical portions (26; 27) in the region of the plug for engagement with the conical portion of the support member.

16. The high-pressure discharge lamp as in claim 15, wherein the internal support member (33; 36; 36′; 36″) is offset with respect to the plug (11) towards the side facing away from the interior of the discharge vessel.

17. The high-pressure discharge lamp as in claim 15, wherein the current feedthrough is joined to the internal support member by means of a friction welding bonding layer (37).

18. The high-pressure discharge lamp as in claim 10, wherein the internal support member (16; 19; 20; 32; 33; 36) has an outer diameter which is less than the inner diameter of the at least one hollow tubular leadthrough by between about 15–50 $\mu$.

19. The high-pressure discharge lamp as in claim 11, wherein said internal support member is a sintered ceramic.

20. The high-pressure discharge lamp as in claim 12, wherein said internal support member is a sintered ceramic.

* * * * *